United States Patent [19]

Geng

[11] 4,000,767

[45] Jan. 4, 1977

[54] LEVERAGE SCREWDRIVER

[76] Inventor: Jerome F. Geng, 94 Hillside Court, Fox Lake, Ill. 60020

[22] Filed: Oct. 9, 1975

[21] Appl. No.: 621,009

[52] U.S. Cl. ..... 145/61 L; 145/50 B

[51] Int. Cl.[2] ..... B25G 1/00; B25G 1/12

[58] Field of Search ..... 145/61 L, 50 R, 50 B, 145/61 G, 65

[56] References Cited

UNITED STATES PATENTS

| | | | |
|---|---|---|---|
| 508,706 | 11/1893 | Hand | 145/61 L |
| 699,773 | 5/1902 | Stump | 145/61 L |
| 722,332 | 3/1903 | Stump | 145/61 L |
| 988,192 | 3/1911 | Hetherington | 145/50 R |
| 1,082,379 | 12/1913 | West | 145/61 F |
| 1,243,667 | 10/1917 | Ard | 145/50 R |
| 2,182,673 | 12/1939 | Magnano | 145/61 L |
| 2,241,965 | 5/1941 | Sjobring | 145/65 |
| 3,863,693 | 2/1975 | Carriker | 145/61 L |
| D142,982 | 11/1945 | Bloomfield | 145/61 L |

FOREIGN PATENTS OR APPLICATIONS

| | | | |
|---|---|---|---|
| 579,494 | 10/1924 | France | 145/61 L |
| 84,668 | 4/1920 | France | 145/50 R |
| 1,351,556 | 12/1963 | France | 145/50 R |

*Primary Examiner*—Al Lawrence Smith
*Assistant Examiner*—J. T. Zatarga

[57] ABSTRACT

A leverage screwdriver assembly with a screw-driving tool receivably held at one end thereof within a drilled axial hole in the end of a gripping handle has a leverage handle pivotally secured to the gripping handle by means of coupling engagement therewith through a pivot member extending transversely through the axial hole. The pivot member, in addition to pivotally coupling the leverage and gripping handles, engages a bearing surface of the tool within the hole to restrain it against both longitudinal and rotary motion relative to the gripping handle.

12 Claims, 4 Drawing Figures

Fig 1
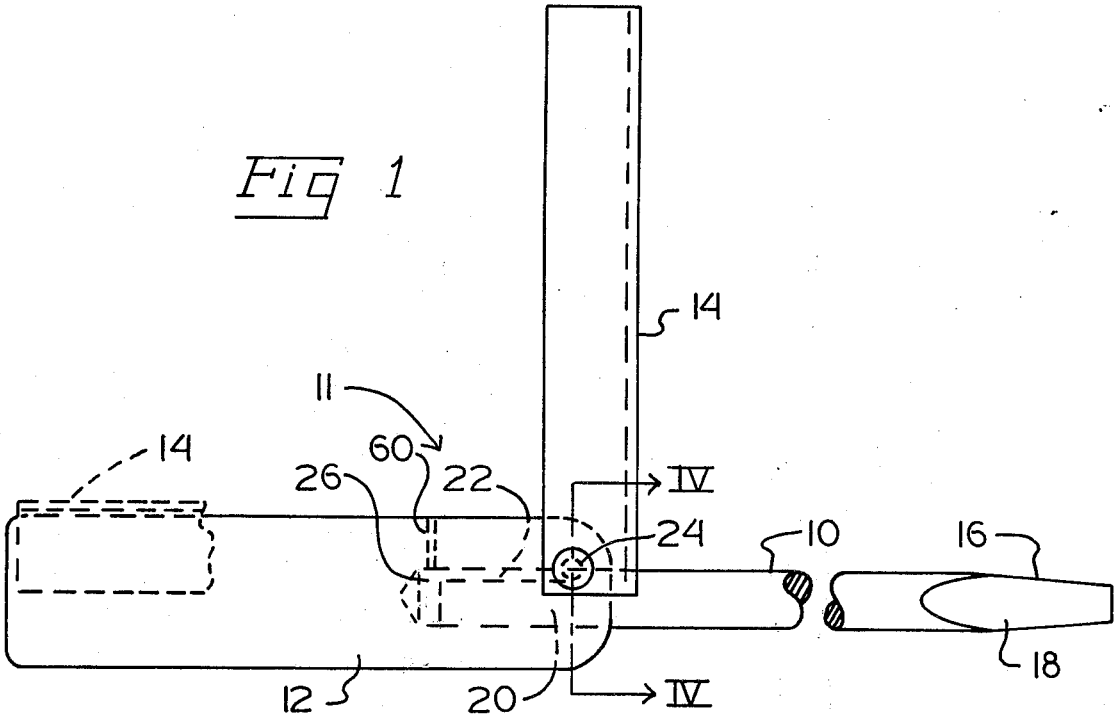
Fig 2
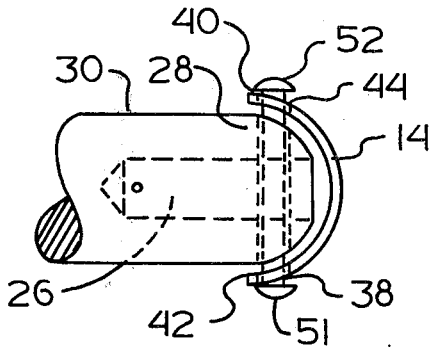
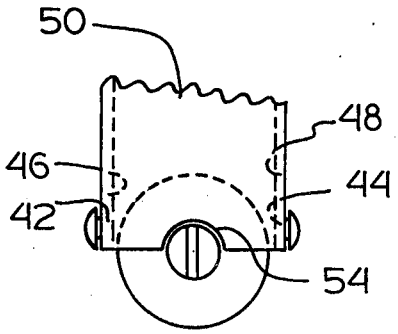
Fig 3
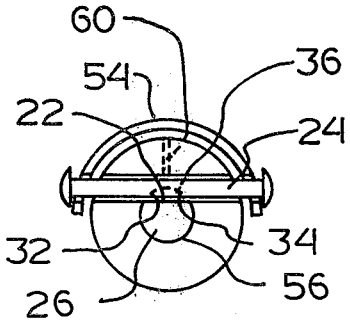
Fig 4

LEVERAGE SCREWDRIVER

BACKGROUND OF THE INVENTION

This invention relates to a hand tool for turning rotary fasteners such as screws and, more particularly, to such a hand tool having a tool shank releasably held by a gripping handle and a leverage handle pivotally mounted thereto.

Screwdrivers of the type having both a conventional gripping handle for holding the tool or tool shank and a leverage handle pivotally secured thereto are known. Examples of such screwdrivers are shown in U.S. Pat. No. 1,530,905 of Nance and in U.S. Pat. No. 1,559,097 of Hill. The leverage handle when not used is folded against the gripping handle in a fashion similar to the closing of a jackknife, and both handles are grasped together. The screwdriver is used as a conventional screwdriver having only a single handle. When, however, greater leverage is needed to turn the screw or other fastener, the leverage handle is pivoted into an operative position extending in a perpendicular direction away from the center axis of the gripping handle and tool shank. With the leverage handle in its operative position, the user applies both a rotary force through the gripping handle while simultaneously, with the other hand, applying another rotary force through the moment arm of the leverage handle. Leverage screwdrivers of this type thus have the advantages of compactness of conventional narrow-handled screwdrivers and yet provide the increased mechanical advantage of large diameter screwdrivers.

Despite this substantial advantage over conventional screwdrivers, the additional cost of adding a leverage handle to a conventional screwdriver handle has prevented widespread commercial success. For example, in the leverage screwdriver of Hill, a specially formed hollow gripping handle is provided for receipt of the leverage handle through an elongate slot therein. In addition, a special head at the end of the tool shank and a bifurcated locking catch associated therewith must be provided to hold the tool shank against relative longitudinal movement. Further, a complicated ratchet assembly is provided to selectively prevent rotation of the tool shank relative to the gripping handle. Likewise, in the leverage screwdriver of Nance, a special pin 7 extending through the tool shank and aligned holes in a lever-supporting member is provided to prevent relative rotation between the gripping handle and the tool shank. Further, as in the screwdriver of Hill, the gripping handle has an elongate slot along one side thereof for receipt of the leverage handle closed thereagainst.

Other leverage screwdrivers are known which eliminate the need for a specially-designed slotted handle, but which, like Nance and Hill, fail to provide a simple and effective means of releasably holding the tool shank against both relative longitudinal and rotational movement with respect to the gripping handle together with a simple and inexpensive method of pivotally securing the leverage handle to the gripping handle.

SUMMARY OF THE INVENTION

The principal object of the present invention is to provide a hand tool assembly of the general type described above which may be inexpensively manufactured.

In accordance with this object, a single pivot member is provided which functions to both pivotally couple the leverage and gripping handles and to restrain the tool against relative rotary and longitudinal movement with respect to the gripping handle. The need for, and thus the cost of, a separate leverage handle-supporting member such as that of Nance is thereby eliminated, as well as the additional cost of separate mechanisms for pivotally securing together the leverage and gripping handles and for holding the tool shank to the gripping handle.

In the illustrative embodiment, the tool shank has a cylindrical section joined with a planar chordal bearing surface section in bearing engagement with the pivot member and fits snugly within cylindrical side walls of the axial hole of the innermost surface of the pivot member. The snug fit of the cylindrical section of the tool shank with the cylindrical side walls of the axial hole prevents relative longitudinal movement between the tool shank and the gripping handle while the engagement of the pivot member against the planar bearing surface prevents relative rotary and longitudinal movement. Thus, the axial hole, being cylindrical, is inexpensively formed by a drilling process and tool shanks inexpensively formed from standard cylindrical stock may be employed therewith.

Coupling is achieved through the ends of the pivot member protruding from opposite sides of the gripping handle. The ends are received within pivot openings in the leverage handle to secure it to the gripping handle.

The foregoing features and advantages will be made more apparent and further features and advantages will be disclosed in the following description of the preferred embodiment.

BRIEF DESCRIPTION OF THE DRAWING

The description of the preferred embodiment is given with reference to the several views of the drawing, in which:

FIG. 1 is a side elevational view of the leverage screwdriver of the present invention with the leverage handle in the operative position shown in solid line and a segment thereof in the closed position shown in broken line;

FIG. 2 is a top view of a portion of the leverage screwdriver of FIG. 1;

FIG. 3 is an end view of the leverage screwdriver shown in FIG. 1; and

FIG. 4 is a view taken along section line IV—IV of FIG. 1, but with the leverage handle in the closed position.

DESCRIPTION OF THE PREFERRED EMBODIMENT

Referring to the drawing, the illustrative embodiment of the leverage screwdriver assembly is seen to include an elongate tool or tool shank 10 such as screw-driving tool and a handle assembly 11. The handle assembly 11 includes an elongate gripping handle 12 and an elongate leverage handle 14. The leverage handle 14 is movable from its operative position, as illustrated in solid line, to a closed position overlying the gripping handle 12, as illustrated by the broken line representation of the free end thereof.

Tool 10 has a fastener-engaging end 16 carrying a screwdriver blade 18. Opposite end 16 is an end 20 having a bearing surface 22. As will be explained in more detail, opposite end 20 is releasably held by gripping handle 12. It is contemplated that a variety of tools 10 be used in conjunction with handle assembly 11 with each different tool having an end 20 substantially identical to that illustrated, but with different fastener-engaging ends 16 to engage different types and sizes of rotary fasteners. For example, the different tools 10 could carry sockets of different sizes to engage hexagonal bolt or screwheads of different sizes.

In accordance with the principal object of the invention, opposite end 20 is releasably held by gripping handle 12 in part through engagement of a pivot member 24 with bearing surface 22. Gripping handle 12 has an axial hole 26 in one end thereof for receiving opposite end 20 of the tool 10. As best seen in FIG. 2, the pivot member 24 extends transversely into the axial hole through a portion 28 of the gripping handle between the outside surface 30 and the axial hole 26. The innermost surface 24 of the pivot member engages the bearing surface 22 to restrain it against axial rotary movement relative to gripping handle 12. In addition, the pivot member 24 is in coupling engagement outside the axial hole with leverage handle 14 to secure it and the gripping handle together for relative pivotal movement between the operative position and the closed position.

Referring to FIG. 4, it is seen that gripping handle 12 has a pair of aligned transverse holes 32 and 34 on opposite sides of axial hole 26 and pivot member 24 extends therethrough across the axial hole 26. The center axes of holes 32 and 34 are tangential to axial hole 26, and thus holes 32 and 34 merge into one another to form a groove 36 aligned and communicating therewith which opens into axial hole 26. The pivot member 26 resides partially within groove 36 and partially protrudes into the axial hole 26. The outermost surface of groove 36 thereby provides rigid support against the outermost surface of the section of pivot member 24 traversing the axial hole 26.

Referring to FIG. 2, the pivot member 24 has a pair of opposite ends 38 and 40 protruding out of the opposite sides of gripping handle 12 and through pivot openings 42 and 44, respectively, of leverage handle 14 to pivotally secure it to gripping handle 12. Leverage handle 14 is generally U-shaped, having a pair of substantially parallel legs 46 and 48 secured to opposite sides of a cross-member 50. In the closed position, the gripping handle 12 is sandwiched between the leg members 46 and 48 and underlies the cross-member 50. The pivot openings 42 and 44 are respectively located in legs 46 and 48 adjacent the forward end thereof and in alignment with one another and the transverse holes 32 and 34.

Pivot member 24 includes a pair of projecting head members 51 and 52 respectively carried at opposite ends 38 and 40 of cross-member 50 to restrain the pivot member 24 against movement out of the aligned holes in gripping handle 12. The legs 46 and 48 are respectively located between the heads 51 and 52 and gripping handle 12, and the opposite ends 38 and 40 of pivot member 24 are thereby also held in coupling engagement with the pivot opening by the head members.

Referring to FIG. 3, the leverage handle 14 is seen to have a semicircular cutout 54 in the forward edge of cross-member 50. This cutout 54 acts as a stop against the tool 10 to prevent leverage handle 14 from being pivoted beyond a position in which it is normal to the elongate axis of gripping handle 12 and tool 10.

Referring to FIG. 4, the axial hole 26 is seen to be cylindrical and thus may be formed by an inexpensive drilling process. The additional expense of a noncylindrical hole is avoided because of the restraining action of pivot member 24 against bearing surface 22. The opposite end 20 of tool 10 has a cylindrical section 56 joined with bearing surface 22 and has a diameter substantially equal to, but slightly less than, that of the axial hole 26. The bearing surface 22 is a planar chordal section spaced radially from the center axis of the cylindrical section 56 by a distance substantially equal to, but slightly less than, the radial distance of the innermost surface of the pivot member 24 from the center axis of the axial hole 26. The tool 10 thereby fits snugly between the side walls of the axial hole 26 and the pivot member 24, and the pivot member 24, through engagement with the bearing surface, frictionally restrains the tool against longitudinal movement relative to the gripping handle in addition to restraining it against relative rotary motion. The engagement of the cylindrical section of end 20 against the cylindrical side walls of axial hole 26 restrains the tool end against pivotal movement relative to gripping handle 12.

Because of the snug fit, a pressure-equalizing hole 60 is provided, as seen in FIGS. 1 and 4. Pressure-equalizing hole 60 communicates with the axial hole 26 from the outside surface of gripping handle 12 for release of air from within axial hole 26 during insertion thereinto of the opposite end 20 of tool 10.

I claim:

1. A hand tool assembly for turning rotary fasteners, comprising:
   - a tool having a fastener-engaging end, an end opposite the fastener-engaging end, and an exterior bearing surface extending from said opposite end toward the fastener-engaging end; and
   - a handle assembly including
     - an elongate gripping handle with an axial hole at one end thereof receiving therewithin the opposite end of the tool,
     - an elongate leverage handle, and
     - a pivot member extending transversely into the axial hole through at least a portion of the gripping handle between one side thereof and the axial hole,
     - said pivot member being in coupling engagement outside of the axial hole with the leverage handle to secure it and the gripping handle together for relative pivotal movement therebetween and
     - being in engagement with the bearing surface of the tool within the hole to prevent axial rotary movement of the tool relative to the gripping handle while releasably restraining the tool against separation from the handle.

2. The hand tool of claim 1 in which said gripping handle has a pair of aligned transverse holes therethrough on opposite sides of the hole for receivably holding said pivot member, and said pivot member extends across the axial hole through said aligned holes.

3. The hand tool of claim 2 in which said gripping handle has a groove aligned and communicating with the pair of aligned holes and opening into the axial hole, and said pivot member resides partially in said groove and partially protrudes into the axial hole.

4. The hand tool of claim 2 including a pair of projecting head members respectively carried at a pair of opposite ends of the pivot member for restraining the pivot member against movement out of the aligned holes.

5. The hand tool of claim 4 in which said pair of opposite ends respectively extend through a pair of pivot openings in the leverage handle and the opposite ends of the pivot member are held in coupling engagement with the pivot openings by said head members.

6. The hand tool of claim 1 in which said pivot member extends through said gripping handle and has a pair of opposite ends protruding from opposite sides thereof in coupling engagement with the leverage handle.

7. The hand tool of claim 6 in which said leverage handle has a pair of substantially parallel legs secured to opposite ends of a cross-member and extending away therefrom toward the gripping handle on opposite sides thereof, and each of said legs has a pivot opening in pivotal coupling receipt of the opposite end of the pivot member adjacent thereto.

8. The hand tool of claim 7 wherein said leverage handle is movable between a closed position in which said gripping handle is sandwiched between the pair of opposite leg members and underlying the cross-member to an operative position in which the leverage handle extends substantially normal to the elongate axis of the gripping handle.

9. The hand tool of claim 1 in which said axial hole is cylindrical and said opposite end of the tool has a cylindrical section joined with said bearing surface of a diameter substantially equal to that of the axial hole, and said bearing surface is a planar chordal section spaced radially from the center axis of the cylindrical section by a distance substantially equal to the radial distance of the pivot member from the center axis of the axial hole.

10. The hand tool of claim 9 in which said axial hole is a cylindrical hole.

11. The hand tool of claim 9 in which the engagement of the innermost surface of the pivot member against the bearing surface frictionally restrains the tool against longitudinal movement relative to the gripping handle.

12. The hand tool of claim 11 in which the opposite end of the tool fits snugly between the side walls of the axial hole and the pivot member, and said gripping handle has a hole communicating with the axial hole from without the gripping handle for release of air from therewithin during insertion of the opposite end of the tool into the axial hole.

* * * * *